US005605096A

United States Patent [19]

Kato

[11] Patent Number: 5,605,096

[45] Date of Patent: Feb. 25, 1997

[54] MECHANICAL PRESSING MACHINE WITH DYNAMIC BALANCING DEVICE

[75] Inventor: Heizaburo Kato, Shizuoka-ken, Japan

[73] Assignee: Sankyo Seisakusho, Tokyo, Japan

[21] Appl. No.: 610,452

[22] Filed: Mar. 4, 1996

Related U.S. Application Data

[63] Continuation-in-part of Ser. No. 293,752, Aug. 22, 1994, abandoned.

[30] Foreign Application Priority Data

Aug. 25, 1993 [JP] Japan ..... 5-210664

[51] Int. Cl.[6] ..... B30B 1/26

[52] U.S. Cl. ..... 100/292; 74/55; 83/615

[58] Field of Search ..... 100/214, 280, 100/282, 292; 72/451, 452; 74/49, 55, 589–591, 603, 604; 83/615, 628

[56] References Cited

U.S. PATENT DOCUMENTS

| | | | |
|---|---|---|---|
| 3,358,592 | 12/1967 | Bradlee | 74/55 |
| 3,662,640 | 5/1972 | Wrona | 100/292 |
| 4,638,731 | 1/1987 | Kato | 100/282 |
| 5,317,893 | 6/1994 | Eigenmann et al. | 100/282 |

FOREIGN PATENT DOCUMENTS

| | | | |
|---|---|---|---|
| 2806584 | 8/1979 | Germany | 100/282 |
| 3537560 | 9/1988 | Germany . | |

OTHER PUBLICATIONS

Übertragungsfunktionen für Kurvengetriebe mit Doppelhubbewegungen, p. 414 Maschinenbautechnik 28 (1979), Prof. Dr.–Ing. habil. J. Volmer (KDT), Dr.–Ing. R. Brock (KDT), Dipl.–Ing. G. Uhlig (KDT) Technische Hochschule Karl–Marx–Stadt.

*Primary Examiner*—Stephen F. Gerrity

*Attorney, Agent, or Firm*—Harness Dickey & Pierce, P.L.C.

[57] ABSTRACT

There is disclosed a mechanical pressing machine utilizing a drive cam, in which an unbalanced inertia force produced during a reciprocal movement of a slider or press member is canceled without producing a flexure in the whole of the pressing machine, thereby enhancing a dynamic precision. A drive cam and a rib cam are fixedly mounted on one end portion of an input shaft, and the slider is reciprocally moved vertically by the drive cam, and a balance weight is driven in the slider in a direction opposite to the direction of movement of the slider through the rib cam, sliding blocks, arms and the balance weight, so that an inertia force produced during the reciprocal movement of the slider is canceled by an oppositely-directed inertia force of the balance weight.

6 Claims, 2 Drawing Sheets

MECHANICAL PRESSING MACHINE WITH DYNAMIC BALANCING DEVICE

CROSS REFERENCE TO RELATED PATENT APPLICATION

The present application is a continuation-in-part of U.S. patent application Ser. No. 08/293,752, filed Aug. 22, 1994 for Mechanical Pressing Machine With Dynamic Balancing Device, abandoned, with its priority based upon Japanese patent application 05-210664, filed Aug. 25, 1993, pending and published in Japan on Mar. 7, 1995.

BACKGROUND OF THE INVENTION

This invention relates generally to a mechanical pressing machine, and more particularly to a mechanical pressing machine provided with a dynamic balancing device for balancing an unbalanced inertia force produced in a reciprocally-moving mechanism utilizing a plate or drive cam.

One known example of mechanical press utilizing a plate cam is the type of press utilizing a constraint cam such as a yoke mechanism. In such a press, a reciprocally-moving member (slider) is connected to a follower through a connecting rod, and a rotational motion of the plate cam is converted into a linear reciprocal motion of the slider. In such a press utilizing the plate cam, when the operation is started, vibrations, resulting from an unbalanced inertia force due to a reciprocal movement of the slider, develop to produce noises and to cause a positional error, as in a conventional crank press. To avoid this, usually, a dynamic balancing device has been used.

In a conventional dynamic balancing device, an unbalanced inertia force of the reciprocating slider is canceled by a balance weight which is equivalent in weight to the slider, and is supported through a cam or links at a position in opposite phase with crests of a plate cam. With this construction, the unbalanced inertia force in the whole of the press is canceled by the balance weight, and therefore vibrations of the press itself (except for the slider and the moving parts) are reduced, thereby enabling a high speed operation of the press.

In the above conventional pressing machine, however, directing attention to the slider having an upper die mounted thereon, an inertia force F, produced during the reciprocal movement, produces a flexure $S=F\times K$ in accordance with the rigidity (spring constant) K of a load propagation path (generally extending from a follower via a driver to a press frame). Generally, this flexure S becomes maximum in the vicinity of a lower dead center, and the dimension of the slider is expanded downward, thus adversely affecting the precision at the lower dead center. And besides, this flexure S is proportional to the inertia force, and therefore is increased as the speed increases. Thus, conventionally, although the pressing machine is apparently rendered quiet by the provision of the dynamic balancing device, this has been found not entirely satisfactory from the viewpoint of the dynamic precision such for example as a lower dead center precision and a coining precision.

SUMMARY OF THE INVENTION

With the above problems in view, it is an object of this invention to provide a mechanical pressing machine provided with a dynamic balancing device capable of achieving a high dynamic precision.

According to the present invention, there is provided a mechanical pressing machine wherein a slider or press member is slidingly moved vertically relative to a frame by a drive cam fixedly mounted on one end portion of an input shaft to which a rotational force of a motor is transmitted; and a balance weight movable in a direction opposite to the direction of movement of the slider is slidably mounted on the slider.

Thus, in the mechanical pressing machine of the present invention, an unbalanced inertia force of the slider or press member is canceled in a slider system, and a load fluctuation is not imparted to the other portion of the pressing machine. More specifically, the balance weight is supported on the slider, and an oppositely-directed inertia force $-F$ relative to an inertia force F produced during the reciprocal movement of the slider is produced by the balance weight, and this oppositely-directed inertia force $-F$ is caused to act on the slider via load transmission means, thereby canceling the inertia force F in the slider system.

Therefore, in the present invention, the inertia force (at least a vertical reciprocal movement) of the slider can be canceled without imparting the load to the other portion, and therefore a dynamic precision can be maintained regardless of a speed change. A load produced in a die is received by a propagation path shared by the dynamic balancing device or by another propagation path, and the rigidity of the press is determined by this propagation path.

DESCRIPTION OF THE PREFERRED EMBODIMENT

Figure 1:
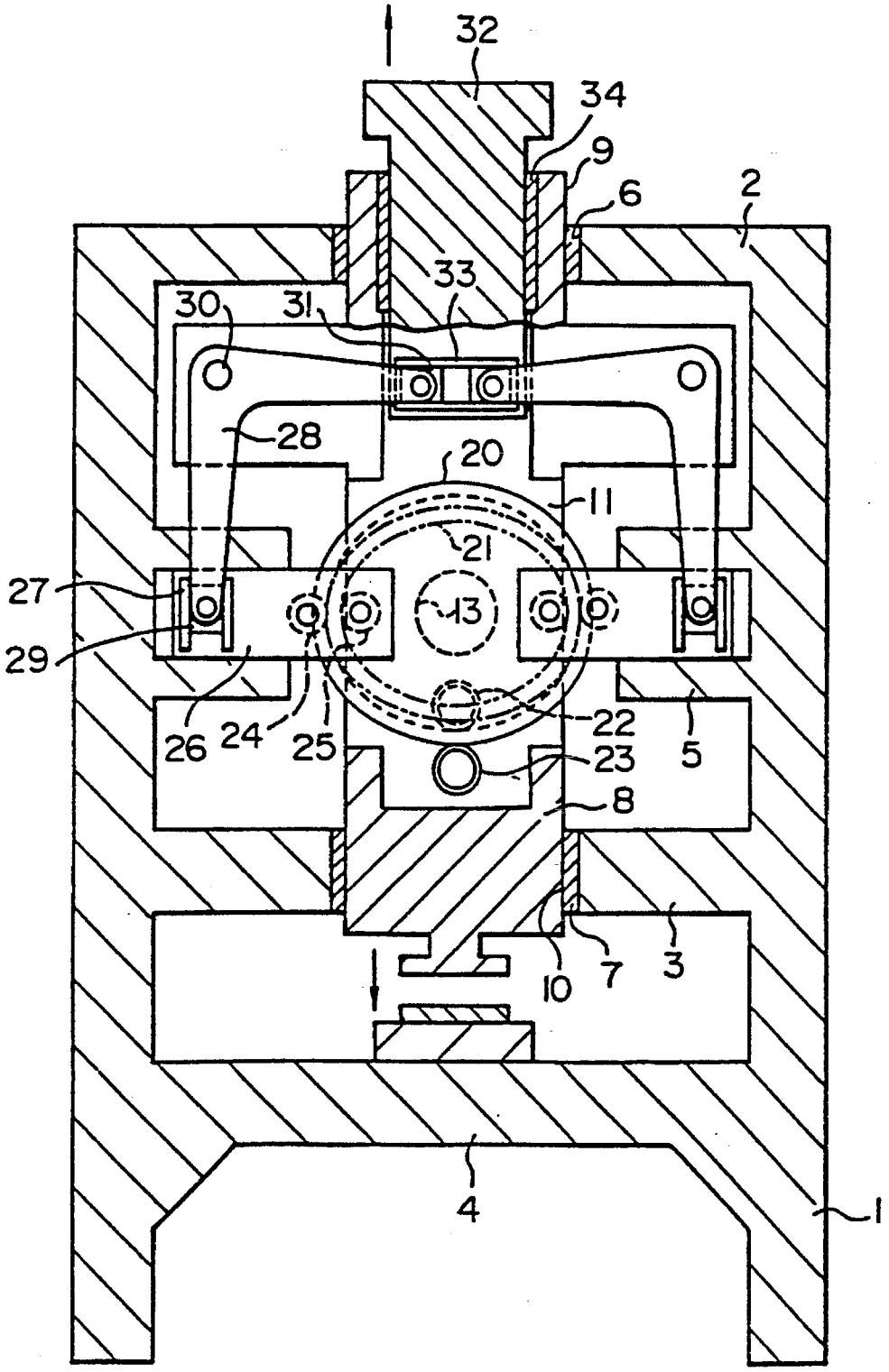
FIG. 1 is a schematic cross-sectional view of one preferred embodiment of a mechanical pressing machine of the present invention as viewed from a front side thereof.
Figure 2:
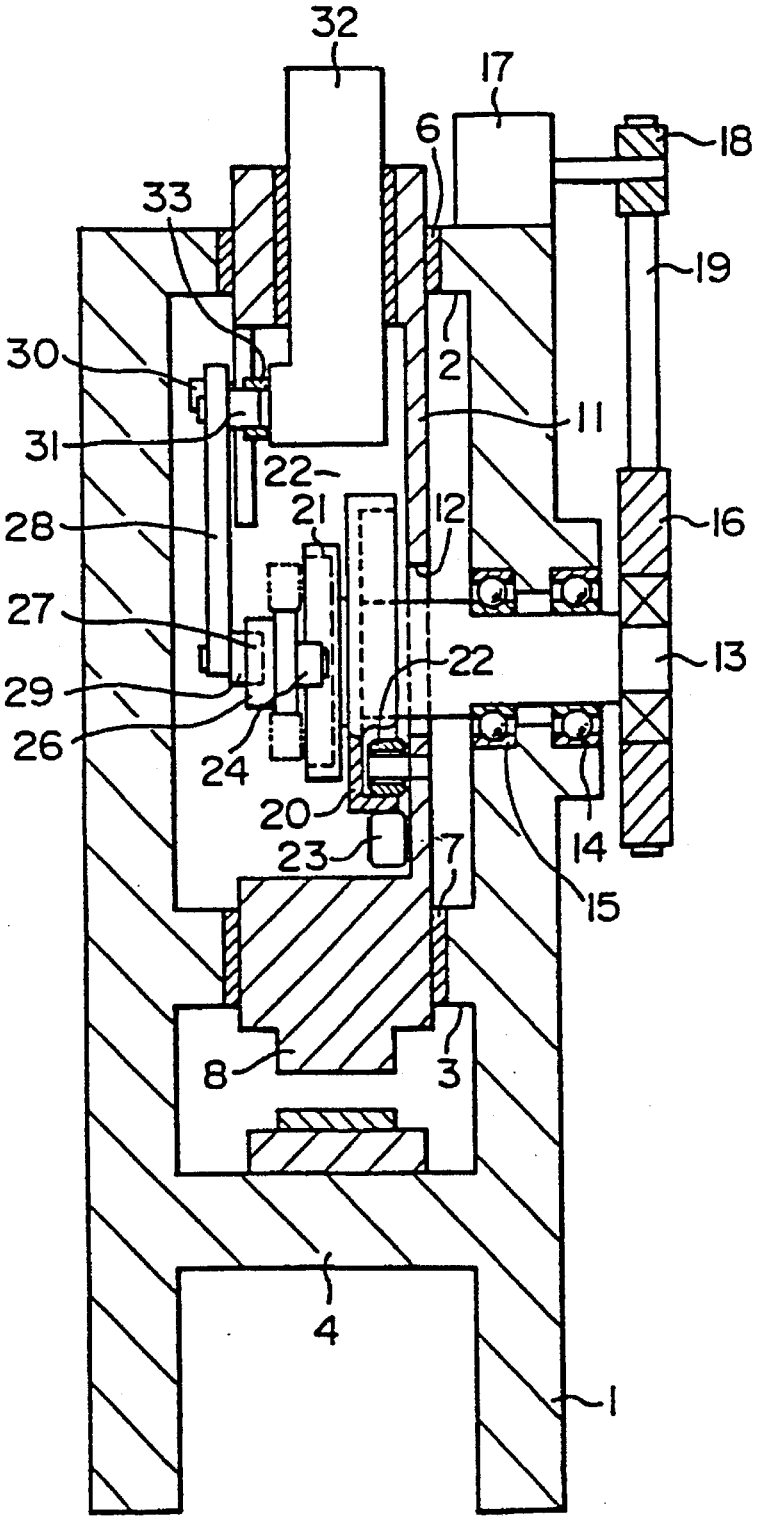
FIG. 2 is a schematic cross-sectional view of the pressing machine as viewed from a side thereof.

FIG. 1 is a schematic cross-sectional view of one preferred embodiment of a mechanical pressing machine of the present invention as viewed from a front side thereof, and FIG. 2 is a schematic cross-sectional view of the pressing, machine as viewed from a side thereof. A frame 1 includes an upper support portion 2, an intermediate support portion 3, a lower support portion 4, and a pair of intermediate projection portions 5 which are provided between the upper support portion 2 and the intermediate support portion 3, and are projected inwardly toward each other, respectively, from right and left side walls of the frame 1. A slider or press member 8 is supported through bearings 6 and 7 on central portions of the upper and intermediate support portions 2 and 3 of the frame 1 for sliding movement in a vertical direction. The slider 8, having an upper press die mounted on a lower surface thereof, has a cross-shape, and includes an upper sliding portion 9 of a rectangular shape supported by the bearing 6, and a lower sliding portion 10 of a rectangular shape supported by the bearing 7. The intermediate portion of the slider 8 is reduced in thickness to provide a back plate 11. A vertically-extending, elongate relief hole 12 is formed through a generally central portion of the back plate 11. An input shaft 13 is rotatably mounted on the frame 1 through bearings 14 and 15, and extends through the relief hole 12. A flywheel 16 is fixedly mounted on one end of the input shaft 13, and is driven by a motor 17 for rotation through a pulley 18, fixedly mounted on a rotation shaft of the motor 17, and a belt 19 extended around the pulley 18 and the flywheel 16, the motor 17 being mounted on the top of the frame 1. An oval-shaped drive cam 20 and a balance or rib cam 21 of an oval shape are fixedly mounted on the other end portion of the input shaft 13. The rib cam 21 has a rim formed at its outer peripheral edge, and this rim is symmetrical with respect to the center or axis of rotation of the rib cam 21. The drive cam 20 is of a shape generally symmetrical with that of the rib cam 21 but is of a different or larger size to accommodate the desired vertical travel of the slider 8. The drive cam 20 also has a rim formed at its outer peripheral edge which rim is also symmetrical with its axis of rotation. A pair of vertically spaced cam followers 22 and 23, rotatably mounted on the back plate 11 of the slider 8, are held in contact with the inner and outer surfaces of the peripheral rim of the drive cam 20. The two cam followers 22 and 23 are rotated in accordance with the rotation of the drive cam 20 to reciprocally move the slider 8 in a vertical direction. The ovally shaped drive cam 20 and rib cam 21 are arranged in such a manner that their longer axes are parallel or coincident with each other, and thus the drive cam 20 and the rib cam 21 are disposed in geometric symmetry with each other. However, as will be seen, their individual actuations are opposite or out of phase to provide the desired dynamic balancing.

In this regard then, a pair of cam followers 24 and 25 are held in contact with outer and inner peripheral surfaces of the peripheral rim of the rib cam 21, respectively, at each of the horizontally opposite (right and left in FIG. 1) sides of the rib cam 21 in such a manner that this peripheral rim is held between the pair of cam followers 24 and 25. The pair of cam followers 24 and 25 are rotatably mounted on an inner end portion of each of a pair of horizontally opposite (right and left in FIG. 1) sliding blocks 26 each of which is mounted respectively on one of the pair of intermediate projection portions 5 of the frame 1 for horizontal sliding movement. A slide guide 27 is fixedly mounted on an outer end portion of each of the sliding blocks 26, and a slide piece 29 rotatably mounted on one end of a bell crank-like arm 28 is engaged in the slide guide 27. The arm 28 is rotatably mounted by a pin 30 on a horizontal extension portion of the slider or press member 8 intermediate opposite ends thereof. A slide piece 31 is rotatably mounted on the other end of the arm 28 and is engaged in a slide guide 33 mounted on a lower end portion of a balance weight 32 received in the upper portion of the slider 8. The balance weight 32 is equivalent in weight to the slider 8, and is slidably received through a bearing 34 in a hole of a rectangular cross-section formed vertically through the upper portion of the slider 8 along the axis thereof. These parts from the rib cam 21 to the balance weight 32 constitute a dynamic balancing device.

The operation of the above mechanical pressing machine will now be described. When the motor 17 is rotated to transmit its rotational force to the flywheel 16 via the pulley 18 and the belt 19 to rotate the drive cam 20 and the rib cam 21, the slider 8 is moved vertically downwardly from the illustrated upper dead center, and at the same time the pair of right and left sliding blocks 26 are moved horizontally toward each other through the rib cam 21. In accordance with this movement, the pair of arms 28 are angularly moved in such a manner that the ends of the arms 28 connected respectively to the sliding blocks 26 move toward each other through the slide guides 27 and the slide pieces 29 whereas the other ends of the arms 28 connected to the balance weight 32 move away form each other through the slide pieces 31 and the slide guide 33. Therefore, the balance weight 32 is urged or moved upwardly. As a result, an inertia force produced in the descending slider or press member 8 is canceled by an oppositely-directed inertia force of the ascending balance weight 32, and therefore a dynamic precision can be maintained regardless of a speed change.

As described above, in the present invention, the balance weight is slidably provided in the slider so as to move in a direction opposite to the direction of movement of the slider, and with this construction an unbalanced inertia force produced during the reciprocal movement of the slider can be canceled in the slider system, and a flexure to be produced in the whole of the pressing machine can be reduced, and therefore the dynamic precision can be enhanced, and also vibrations and noises can be reduced.

What is claimed is:

1. In a mechanical pressing machine wherein a slider is slidingly moved vertically relative to a frame by a drive cam fixedly mounted on one end portion of an input shaft to which a rotational force of a motor is transmitted;

the improvement wherein a balance weight movable in a direction opposite to the direction of movement of said slider is slidably mounted on said slider.

2. A mechanical pressing machine comprising:

a slider supported on a frame for vertical sliding movement, said slider having an upper press die mounted on its lower surface;

an input shaft rotatably mounted on said frame and connected at its one end to rotation transmission means, the other end portion of said input shaft extending through said slider;

a pair of vertical upper and lower first cam followers mounted on said slider;

a pair of right and left sliding blocks mounted on said frame for horizontal sliding movement;

two pairs of second cam followers with each pair separately mounted on one of said pair of sliding blocks;

a drive cam fixedly mounted on said other end portion of said input shaft, said drive cam being constrained by said pair of upper and lower cam followers so as to limit a vertical movement of said slider;

a rib cam fixedly mounted on said other end portion of said input shaft, said rib cam being constrained by said two pairs of second cam followers, mounted respectively on said pair of sliding blocks, so as to reciprocally move said pair of sliding blocks in a horizontal direction;

a pair of right and left arms of a generally bell crank-shape vertically movably connected at their one ends respectively to said pair of sliding blocks, each of said pair of arms being rotatably connected to said slider intermediate opposite ends thereof; and a balance weight received in an upper portion of said slider for vertical displacement relative to said slider, the other ends of said pair of arms being connected to a lower portion of said balance weight for horizontal sliding movement.

3. A mechanical pressing machine according to claim 2, in which said drive cam has an oval-shape with a rim formed at its outer peripheral edge which rim is symmetrical with respect to an axis of rotation of said drive cam, and said rib cam has an oval shape with a rim formed at its outer peripheral edge which rim is symmetrical with respect to an axis of rotation of said rib cam, said drive cam and said rib cam being arranged in such a manner that their longer axes are generally coincident with each other, said first pair of cams being vertically disposed in such a manner that said rim of said drive cam is held between said first pair of cams, and said two pairs of second cam followers being disposed respectively at right and left sides of said rib cam in such a manner that said rim of said rib cam is held between said each pair of second cam followers.

4. A mechanical pressing machine according to claim 3, in which a slide piece is rotatably mounted on each of the opposite ends of each of said pair of arms, and each said slide piece being mounted on the opposite ends respectively of each of said pair of arms and are slidably engaged respectively in a first slide guide mounted on each of said sliding blocks, and a second slide guide mounted on said balance weight.

5. A mechanical pressing machine comprising:

a press member supported on a frame for reciprocating vertical movement, said press member having a press die mounted on a lower surface;

first actuating means operatively connected with said press member for moving said press member in its reciprocating vertical movement, a balance weight member received in an upper portion of said press member for vertical reciprocating movement relative to said press member, said actuating means operatively connected with said balance weight member for moving said balance weight member vertically in opposite directions to said press member for balancing the inertia force created by said press member in its reciprocating vertical movement.

6. A mechanical pressing machine comprising:

a press member supported on a frame for reciprocating vertical movement, said press member having a press die mounted on a lower surface;

an input shaft rotatably mounted on said frame and connected to rotation transmission means, said rotation transmission means being actuable for rotating said input shaft, a drive cam operatively connected to said input shaft for rotation by said input shaft, first cam follower means mounted on said press member and operatively associated with said drive cam for imparting vertical reciprocating motion to said press member in response to rotation of said drive cam while limiting the extent of vertical movement of said press member;

a rib cam operatively connected to said input shaft for rotation by said input shaft, second cam follower means connected to said frame and operatively associated with said rib cam for horizontal movement in response to rotation of said rib cam;

a balance weight received in an upper portion of said press member for vertical displacement relative to said press member, arm means connected with said second cam follower means and rotatably connected to said press member for imparting vertical reciprocating motion to said balance weight in response to horizontal movement of said second cam follower means with the vertical reciprocating motion of said balance weight being opposite to that of said press member for balancing the inertia force created by said press member in its reciprocating vertical movement.

* * * * *